United States Patent [19]

Sharp

[11] Patent Number: 4,793,556

[45] Date of Patent: Dec. 27, 1988

[54] METHOD OF AND APPARATUS FOR THE NEBULIZATION OF LIQUIDS AND LIQUID SUSPENSIONS

[75] Inventor: Barry L. Sharp, Skene, Scotland

[73] Assignee: National Research Development Corporation, London, England

[21] Appl. No.: 96,233

[22] Filed: Sep. 8, 1987

Related U.S. Application Data

[63] Continuation of Ser. No. 812,645, Dec. 23, 1985, abandoned.

[30] Foreign Application Priority Data

Dec. 21, 1984 [GB] United Kingdom ..... 8432338

[51] Int. Cl.[4] ..... B05B 1/02; B05B 7/08

[52] U.S. Cl. ..... 239/418; 239/426; 239/589; 261/78.2; 261/DIG. 65

[58] Field of Search ..... 239/311, 314, 338, 340, 239/369, 418, 423, 424, 433, 434.5, 543, 589, DIG. 21; 261/78.2, DIG. 65

[56] References Cited

U.S. PATENT DOCUMENTS

| | | | |
|---|---|---|---|
| 966,704 | 8/1910 | Pickles | 239/418 X |
| 2,616,762 | 11/1952 | Holmes | 239/369 X |
| 3,421,692 | 1/1969 | Babington et al. | 261/78.2 X |
| 3,421,699 | 1/1969 | Babington et al. | 261/78.2 X |
| 3,472,455 | 10/1969 | Johnson et al. | 239/338 X |
| 3,473,530 | 10/1969 | Urbanowicz | 239/338 X |
| 3,774,846 | 11/1973 | Schurig et al. | 261/78.2 X |
| 4,413,784 | 11/1983 | Dea | 239/426 |

OTHER PUBLICATIONS

Apel, Charles et al, Investigations of the Inductively Coupled Plasma Source for Analyzing NURE Water Samples at the Los Alamos Scientific Laboratory, Mar. 1977.

*Primary Examiner*—Andres Kashnikow
*Assistant Examiner*—Mary Beth D. Jones
*Attorney, Agent, or Firm*—Cushman, Darby & Cushman

[57] ABSTRACT

A device for nebulization of fluid materials includes a nozzle(s) for an emergenece of gas from a high pressure supply (1). A conical guide wall (7) receives fluid materials from a tube (b 8). The angle of the guide wall is greater than the Prandtl-Mayer angle of the emergent gas stream (9).

3 Claims, 1 Drawing Sheet

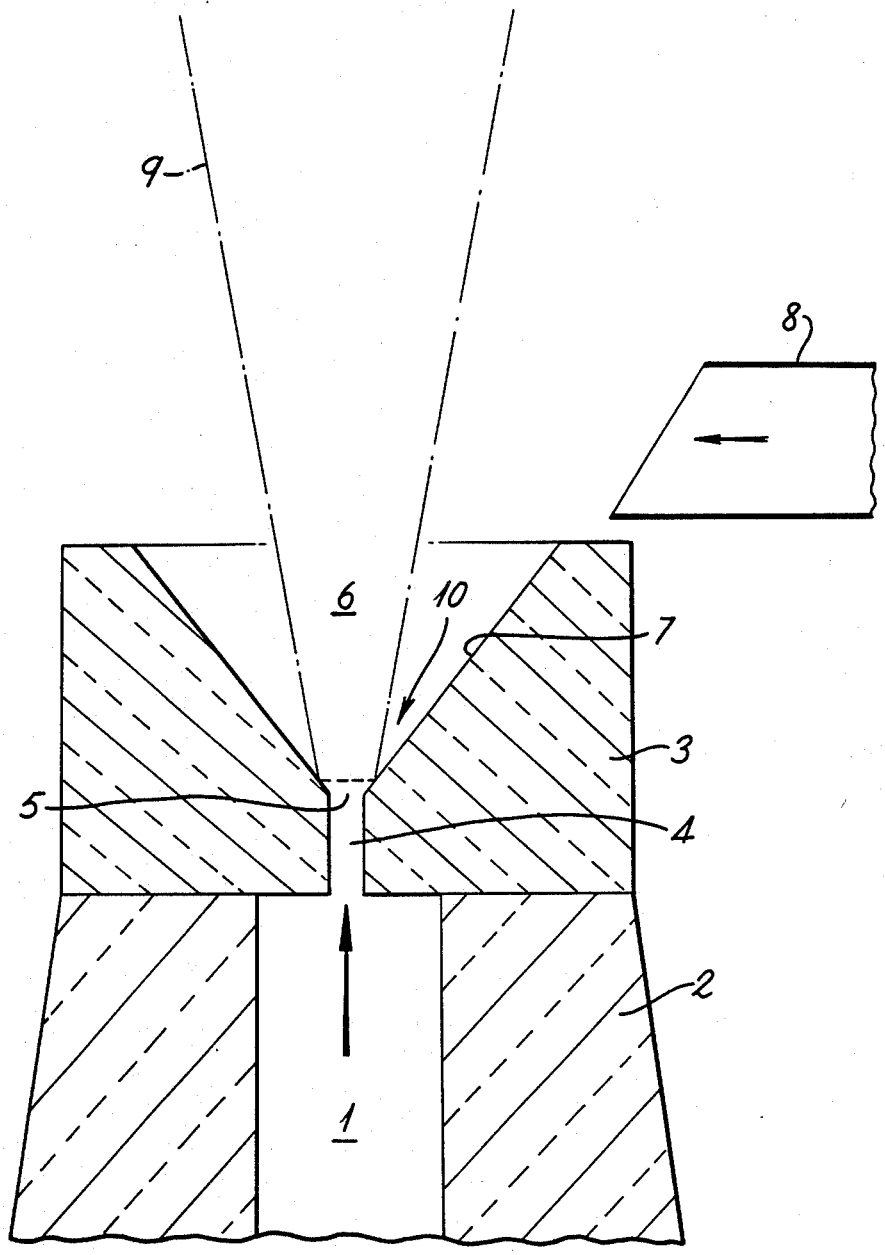
9
8
6
10
7
3
5
4
2
1

METHOD OF AND APPARATUS FOR THE NEBULIZATION OF LIQUIDS AND LIQUID SUSPENSIONS

This is a continuation of application Ser. No. 812,645, filed Dec. 23, 1985, which was abandoned upon the filing hereof.

This invention relates to the nebulisation of liquids and liquids containing suspended solids.

Nebulisers are devices used for the production of aerosols from both pure liquids and liquids with high levels of dissolved solids or particulates. One application is for the introduction of samples into an inductively coupled plasma for spectrochemical analysis or into chemical flames for atomic absorption spectrometry.

There are four main types of nebuliser in current use for sample introduction into inductively coupled plasmas. These are the concentric-flow nebuliser, the cross-flow nebuliser, the V-groove nebuliser and the frit nebuliser. Only the concentric-flow nebuliser has found general application for flame spectrochemical analysis. All existing pneumatic nebulisers produce polydisperse aerosols and are therefore coupled to spray chambers that remove the larger droplets.

The concentric-flow nebuliser products a fine spray and is self-priming, but the gas flow annulus is very narrow (10–30 μm) and tends to salt up when samples containing high levels of dissolved solids (2%) are introduced. Manufacturers employing this design in inductively coupled plasma systems are gas wetting and periodic washing of the gas annulus to keep the nebulizer running. The liquid introduction capillary is also quite narrow (250 μm) and blocks if the solution contains suspended solids. Concentric nebulisers are difficult to make to a reliable specification because of the difficulty in reproducing the tip geometry, particularly the width and concentricity of the gas annulus.

The cross-flow nebuliser if self priming and produces a very fine spray particularly when operated at higher pressures (e.g. 200 p.s.i.g.). It is more tolerant of dissolved solids than the concentric flow, tolerating levels in excess of 10%. It cannot handle slurries because of the narrowness of the sample introduction capillary (150–250 μm). Like the concentric-flow nebuliser it is difficult to manufacture, in part because of the fineness of the orifices used, but in particular because the relative alignment of the gas and liquid capillaries is critical. The V-groove nebuliser is a derivative of the Babington spherical nebuliser. The V-groove greatly reduces the solution flow rate required to produce a stable spray. Because the V-groove acts as the liquid delivery channel, the solution is not restricted to a narrow capillary and the device can spray solutions containing high levels of dissolved solids or slurries. The V-groove nebuliser is not self-priming and is therefore fed by a pump (usually a peristaltic pump), the solution being run into the V-groove from a fairly coarse capillary of 0.5–1.0 mm diameter. Achieving a stable operation of this type of nebuliser requires careful design of the liquid feed geometry and the device needs to be orientated such that the solution runs along the groove under the action of gravity. In spite of its obvious advantages, the V-groove nebuliser is not widely used because it appears to produce a coarser spray, and is therefore less efficient, and produces more noise on the optical signal than the other types. The geometry of the V-groove nebuliser does not produce effective mixing of the liquid and gas phases. The contact area of the liquid and gas is limited to the gas jet periphery on one side of the jet.

The frit nebuliser produces a much finer spray than any of the other types and is therefore the most efficient. The device is pump fed, solution being run onto the face of the frit from a capillary tube. The frit nebuliser can be operated with low gas consumption, and low solution feed rates, if required. There are, however, persistent memory affects due to the trapping of solution in the pores of the frit. Thus changing from one sample to another is hindered by the necessity for careful washing of the frit.

In order to overcome these disadvantages we have devised a new form of nebuliser.

According to the present invention, there is provided apparatus for the nebulisation of fluid materials comprising an expansion nozzle connectible to a gas supply and having an orifice for the emergence of a divergent stream of gas from said gas supply into an exhaust region partially bounded by a guide wall divergent from said orifice, fluid materials transport means to convey said fluid materials from a source to said guide wall to introduce said materials into said stream of gas wherein said guide wall diverges from said orifice at an angle greater than the angle of divergence of said emergent stream of gas.

An embodiment of the invention will now be described by way of example, with reference to the accompanying drawings in which FIG. 1 is a sectional view through a nebuliser having a conical exhaust region.

Referring now to the drawing which illustrates only the essential working parts, a conduit 1 in a glass support member 2 leads gas from a gas supply (not shown) to a sapphire nozzle 3. A capillary or passage of small diameter 4 leads from the conduit 1 to an orifice 5 which opens into an exhaust region 6. A conical guide wall 7 diverges from the orifice 6. A chemically resistant tube 8 conveys fluid materials from a source (not shown) to the guide wall 7.

The nebuliser is used in the pressure range $1.0–20.0\times10^5$ Pa and, since the nozzle is choked, the exit plane Mach number is unit. Outside the nozzle, the gas expands further, attaining supersonic velocities and producing a pressure undershoot on the axis. This causes the gas flow to diverge from the orifice at an angle $\omega$, known as the Prandtl-Meyer angle, given by $$\omega = \sqrt{\frac{k+1}{k-1}}\ \tan^{-1}\sqrt{\frac{k-1(M^2-1)}{k+1}}\ \tan^{1}\sqrt{M^2-1}$$

where k is the ratio of the specific heats (Cp/Cv) for th gas and M is the issuing Mach number.

The maximum turning angle for centred axisymmetric expansion such as occurs in free jet or nozzle is $$\theta_{max}=\tfrac{1}{2}\omega$$

In a practical embodiment, nozzles operated on Argon gas (k=1.667) at pressures up to $20.0\times10^5$ Pa are unlikely to exceed M=3, giving a maximum wall deflection of 19.465° corresponding to a cone angle of 38.93°.

In the present invention, the angle of divergence of the guide wall at the orifice is chosen to exceed this angle ($\theta_{max}$). In one embodiment, an angle of 80° was used. The effect of this is to produce a region of strong viscous entrainment and backflow along the walls of the conical section. A solution introduced to the adjacent surface of the guide wall is sucked down into the conical section and spreads uniformly around it due to capillary action. The liquid film thus produced intersects with the gas jet along an annular ring near the orifice. A fine spray is produced and the presence of the spray further enhances the backflow process. The nebuliser is not self priming, requiring a pump to deliver the solution to the guide wall lip, however, the strong entrainment in the cone allows the device to be used in any orientation, even inverted. In a vertical orientation, gravity assists the flow of liquid into the cone.

The present apparatus does not require that the liquid phase be restricted to a narrow capillary. It uses a 300 μm diameter delivery tube, but wider tubes may also be used. The device is well suited to solutions containing high levels of dissolved solids, or suspended particulates. Furthermore, the alignment of the solution delivery tube is not critical.

Nebulisers are known to be one of the principal sources of noise in analytical flame and plasma spectroscopy. We have found that in part, the noise derives from the process of renebulisation. This occurs because when the nebuliser is in operation inside the spray chamber its component parts are continually soaked in solution. Droplets collect near the neublising surface and are then entrained and resprayed, often in a random and unstable fashion. Observations of the present apparatus indicate that because the point of nebulisation is inside the conical section, it is protected by the outflux of gas and particles and renebulisation does not occur to the same extent. If it does occur, the resultant noise components are of a lower amplitude and higher frequency than those produced by conventional designs.

An essential feature of the present invention is the use of a divergent expansion section after the nozzle throat. Although a conical guide wall has been particularly described, other divergent channel shapes of suitable angle may be used.

I claim:

1. Apparatus for the nebulisation of fluid materials comprising an expansion nozzle connectible to a gas supply and having an orifice for the emergence of a divergent stream of gas from said gas supply into an exhaust region partially bounded by a guide wall convergent towards said orifice, fluid materials transport means to convey said fluid materials from a source to said guide wall to introduce said fluid materials into said stream of gas wherein said guide wall is substantially conical and converges towards said orifice at an angle greater than the Prandtl-Mayer angle for the gas from said gas supply to create a region of entrainment and backflow of said fluid materials along said guide wall towards said orifice and wherein said fluid transport means terminates adjacent said region of entrainment and backflow.

2. Apparatus for the nebulisation of fluid materials as claimed in claim 1 wherein said fluid materials transport means comprises a tube positioned between said source and said guide wall.

3. Apparatus for the nebulisation of fluid materials as claimed in claim 2 wherein said tube is of small internal diameter.

* * * * *